US005382176A

United States Patent [19]

Norden

[11] Patent Number: 5,382,176

[45] Date of Patent: Jan. 17, 1995

[54] ELECTRICAL CONNECTORS

[75] Inventor: Alexander R. Norden, Boca Raton, Fla.

[73] Assignee: Cooper Industries Inc., Houston, Tex.

[21] Appl. No.: 997,023

[22] Filed: Dec. 28, 1992

[51] Int. Cl.[6] ..... H01R 13/627

[52] U.S. Cl. ..... 439/357; 439/304

[58] Field of Search ..... 439/350–358, 439/304

[56] References Cited

U.S. PATENT DOCUMENTS 4,211,461 7/1980 Wescott ..... 439/357
4,412,714 11/1983 Morningstar et al. ..... 439/352
4,449,778 5/1984 Lane ..... 439/357
4,900,261 2/1990 Gentry et al. ..... 439/357
4,915,336 4/1990 Handy ..... 439/304
4,925,398 5/1990 Samejima ..... 439/350

*Primary Examiner*—Gary F. Paumen
*Assistant Examiner*—Hien D. Vu

[57] ABSTRACT

A latch-and-catch which prevents companion plug-in terminal blocks from parting is released by an elongated tool such as a screwdriver. The tool maintains the latch released while applying a thrust to separate the terminal blocks.

14 Claims, 2 Drawing Sheets

FIG. 1
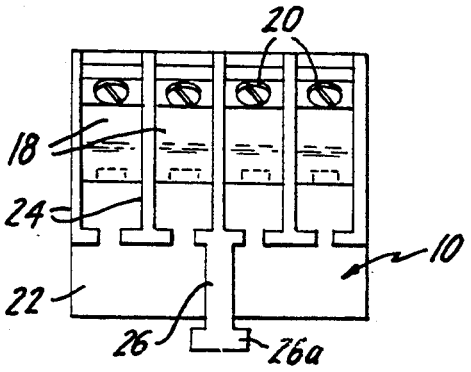
FIG. 2
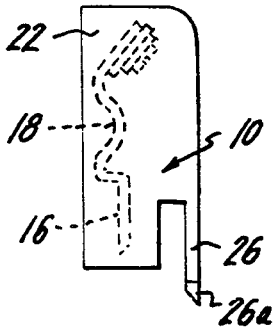
FIG. 3
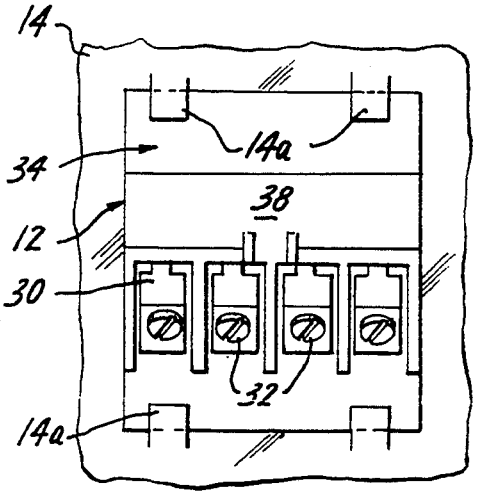
FIG. 4
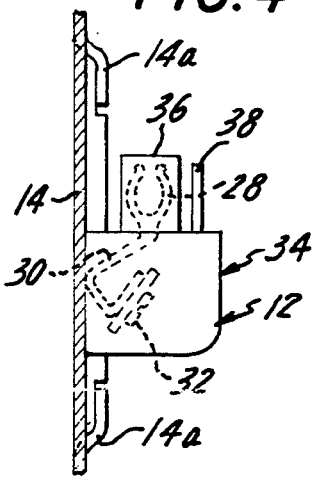
FIG. 5
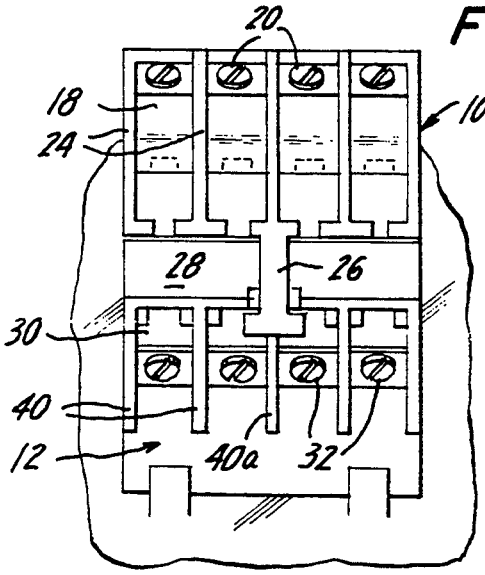
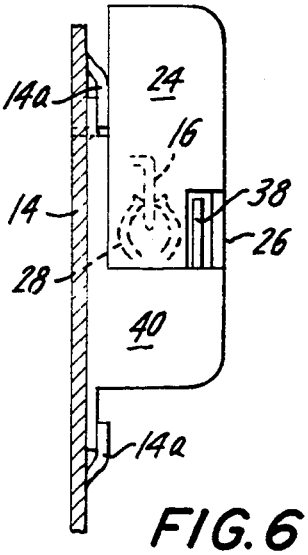
FIG. 6

ELECTRICAL CONNECTORS

The present invention relates to electrical plug-in connectors and to a combination of plug-in connectors with a connector-separating tool.

BACKGROUND OF THE INVENTION

Plug-in connectors comprise a plug-in connector and a mounted receptacle, or two mating plug-in connectors are used for connecting and disconnecting multiple-wire cables.

A variety of arrangements and devices are known for holding a pair of connectors together securely, in their plugged-in condition. The friction of the plugged-in contacts may provide sufficient retention. Resilient detents are used widely, but detents increase the required separating force, first to overpower the detent and then to overcome the frictional retention of mating contacts of the connectors. Contact friction combined with a detent may not provide sufficient retention; the connectors remain vulnerable to accidental or unintended separation.

A retainer having a latch and a catch is known for blocking connectors of a plugged-in connector pair against accidental separation. This form of retainer is considered to be positive; its design should be such as to require deliberate release before the connectors can be separated. Where a latch-and-catch locking device is used, the latch must be pried or otherwise manipulated as a preliminary to unplugging the connectors. The latch must be held in its released condition until separation of the connectors has progressed far enough to forestall reengagement of the latch and catch.

SUMMARY OF THE INVENTION

The present invention involves electrical plug-in connectors that are separable forcibly. A latch is provided on one connector that coacts with a catch on the other connector to block the connectors against becoming separated accidentally, whether because of jostling, vibration or other extraneous causes. One connector has an abutment against which connector-separating thrust is to be applied. The latch is disposed adjacent to the path of a thrust-applying tool such that, in one stroke of the tool, the latch is first released and then maintained released while the tool advances against the abutment and drives the connectors at least partway apart, i.e., sufficient to prevent the latch from reengaging the catch. The connectors are unplugged by the thrust of the tool or they are unplugged at least partway by the tool's thrust, sufficiently to prevent reengagement of the latch. As will be seen in the following detailed description of the illustrative embodiment, a screwdriver with a wedge-like end portion has special advantages as the connector-separating tool.

The connectors may be two devices that interconnect and disconnect multiple wires of two cables. In the form used as the illustrative embodiment of the invention, one connector is a receptacle to be mounted as part of a circuit assembly, while the other connector provides for separable connection of a multiple-wire cable to the circuit assembly.

Further features and advantages of the invention will become apparent from the following detailed description of an illustrative presently preferred embodiment which is shown in the accompanying drawings.

BRIEF DESCRIPTION OF THE DRAWINGS

In the accompanying drawings:

FIGS. 1 and 2 are front and side views, respectively, of a novel plug-in connector;

FIGS. 3 and 4 are front and side views, respectively, of a novel mounted companion connector;

FIGS. 5 and 6 are front and side views, respectively, of assembled connectors of FIGS. 1–4 including part of a mounting plate which is shown in cross-section in FIG. 6;

DETAILED DESCRIPTION OF THE ILLUSTRATIVE EMBODIMENT

Figure 9:
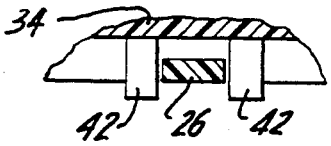
FIG. 9 is a fragmentary detail of the assembled connectors of FIGS. 5–8 as seen at the plane 9—9 in FIG. 7.

Referring now to the drawings in detail, plug-in connector 10 is shown by itself in FIGS. 1 and 2. Another connector, in the form of receptacle 12, is shown by itself in FIGS. 3 and 4. Plug-in connector 10 is shown assembled to receptacle 12 in FIGS. 5 and 6. Lanced tabs **14*a* of mounting plate 14 are an illustrative means for holding receptacle 12** in a fixed position.

Plug-in contacts 16 in connector 10 are parts of metal strips 18 that extend to respective wire fasteners 20. Each of the metal strips 18 is mechanically locked in place in molded block 22 of insulation. Interphase barriers 24 are integral portions of block 22, for separating each pole 16–18–20 from its neighboring pole(s). Elongated roughly T-shaped latch member 26 extends integrally from block 22 to its latching end portion **26*a***.

Receptacle 12 in FIG. 4 includes two-jaw plug-in contacts 28 that are integral portions of metal strips 30. These strips extend to respective wire fasteners 32. A block 34 of molded insulation has integral square tubes 36 of insulation surrounding contacts 28, tubes 36 being open-ended to admit contacts 16 of the plug-in connector 10. Block 34 of insulation also has an integral insulating barrier 38 across all the poles; the interphase barriers 40 flank each pole 28–30–32.

The details of latch 26 and cooperating catches are best shown in FIGS. 7–11.

Figure 7:
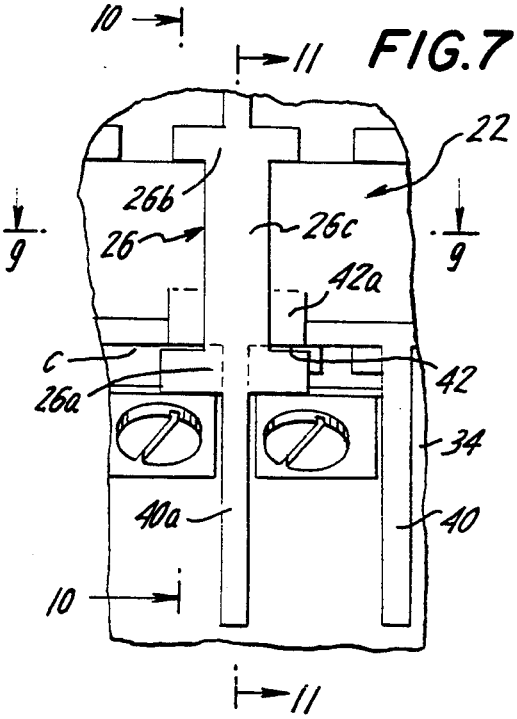
FIG. 7 is an enlarged fragmentary front view of the assembled connectors of FIG. 5.
Figure 8:
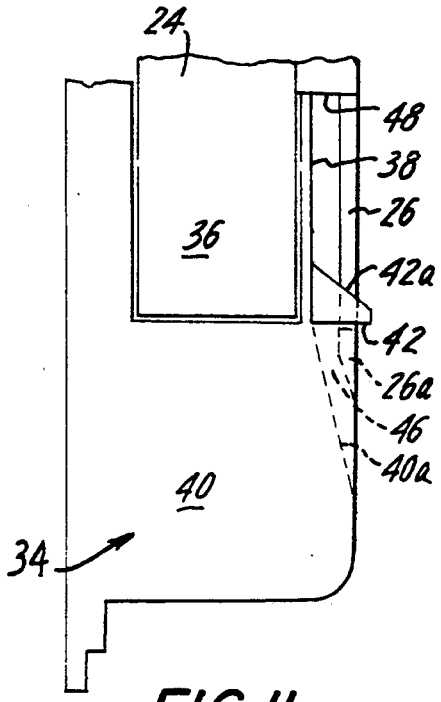
FIG. 8 is an enlarged fragmentary side view of the novel assembled connectors of FIG. 6.
Figure 10:
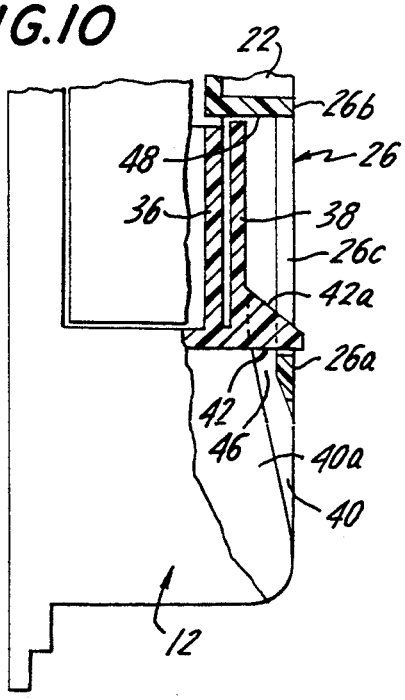
FIG. 10 is a side view like FIG. 8, portions being broken away and shown in cross-section at the plane 10—10 in FIG. 7.
Figure 11:
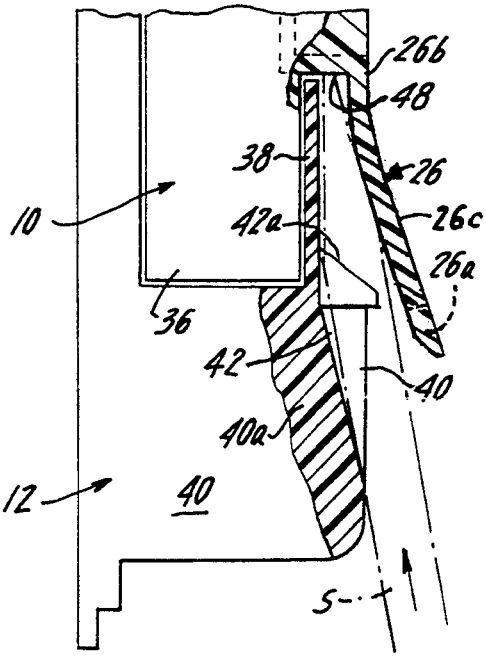
FIG. 11 is a side view like FIGS. 8 and 10 of the connectors of FIGS. 5 and 6, portions being broken away and shown in cross-section at the plane 11—11 in FIG. 7, except that the latch in FIG. 11 is shown deflected by a screwdriver that is shown in phantom.

In FIG. 7, fixed end portion **26*b* of latch 26 extends from block 22. Elongated latch portion 26*c* carries movable latching end portion 26*a*. Latch 26 is T-shaped, an inverted "T" in FIG. 7. The two projections of latch portion 26*a* which extend in opposite directions from the sides of elongated portion 26*c*** provide latching shoulders.

Block 34 of insulation, being part of fixed receptacle 12, has two shoulders or catches 42 to cooperate with the latching shoulders of latch portion **26*a*. Latch 26 is quite resilient; it can be deflected (FIG. 11), but it is self-restoring to its at-rest condition shown in FIGS. 8–10. Block 22 may be a suitable grade of nylon which provides the resilience of latch 26** and provides the required insulation properties.

Interphase barriers 40 of insulating block 34 are essentially alike. The middle interphase barrier 40*a* that is centered opposite portion 26*a* of the latch has a modified shape: its front edge slants so that there is a clearance space 46 (FIG. 10) between latch portion 26*a* and interphase barrier 40*a* The front or right-hand edge of barrier 40*a* merges smoothly with the outer surface of barrier 38, the right-side surface of barrier 38 in FIG. 10. As noted below, these merging surfaces form a smooth guide for a screwdriver. Catches 42 are spaced apart to admit the screwdriver.

At the fixed end 26*b* of latch 26, block 22 is shaped to provide an abutment 48 (FIG. 10) directly behind the latch where the latch extends from the rest of block 22.

When the plug-in connector 10 is fully plugged into receptacle 12, there may be a small amount of clearance C between each catch 42 and the respective latching shoulders provided by end portion 26*a* of the latch. A small shift of plug-in connector in the unplugging direction would move those latching shoulders against catches 42. After connector 10 has been plugged into receptacle 12, latch 26 and catches 42 block the connectors against being unplugged.

When the connectors are to be separated, a screwdriver or similar tool is introduced endwise into the space or passage 46, deflecting and releasing latch 26. As the screwdriver advances to abutment 48, the latch remains deflected. If the screwdriver were removed, the latch would again abut catches 42.

The screwdriver maintains the latch in released condition as the end of the screwdriver is moved against abutment 48. Thrust of the screwdriver's end against abutment 48 drives plug-in connector 10 away from receptacle 12. Mounting plate 14 restrains receptacle 12 as connector 10 is being unplugged. If receptacle 12 had been an unmounted plug-in terminal block, as when a pair of connectors are used to connect and disconnect two multiple-wire cables, connector 12 would be restrained manually as the screwdriver is forced into and beyond the point where the connectors are at least partway unplugged.

If space 46 were larger or if the screwdriver (or other tool) were very slender, the simple insertion of the tool into space 46 might not release the latch. Even then, the tool could be manipulated to release latch 26 and hold the latch released as the tool is driven forward endwise to shift connector 10 at least far enough to prevent latch 26 from becoming relatched. At that point—after some unplugging thrust of the tool—the tool could be removed; the connectors would not be relatched.

Using a screwdriver as the connector-separating tool has the advantage that the narrow end of the wedge formation of the screwdriver can easily be inserted into a narrow passage 46 (FIG. 10), the wedge then acting to deflect and release latch 26 as the screwdriver is thrust toward abutment 48.

When the plug-in connector 10 is next plugged into receptacle 12, latch portion 26*a* is cammed by slant surface 42*a* of catch 42 until latch portion 26*a* has been shifted past catches 42. The latch snaps into its condition in FIG. 10, blocking separation of the connectors.

The connectors 10 and 12 represent typical forms of plug-in connectors. The shape of latch 26 and catch or catches 42 as shown is very effective but, of course, various forms of the latch and catch may be substituted. For example, latch 26 might be made L-shaped for coaction with only one catch 42. This and other changes may be made by those skilled in the art. Consequently, the invention should be construed broadly, in its true scope.

What is claimed is:

1. In combination, first and second electrical connectors and a connector-separating tool, said connectors having respective contacts, the contacts of said first connector mating with respective contacts of said second connector when the connectors are in their plugged-in condition, one of said connectors having a resilient latch and the other of said connectors having a catch cooperable with the latch for blocking separation of the connectors, said first connector having an abutment against which thrust may be applied for separating the connectors while the second connector is restrained, said other of said connectors providing a passage therealong adjacent to said catch for insertion of said tool, said tool being operable along said passage both for releasing the latch from the catch and, while the latch is held released by the tool, for applying connector-separating thrust to said abutment.

2. The combination as in claim 1, wherein the latch is a resilient elongated member and wherein the tool is elongated, said tool extending generally along the resilient elongated member and deflecting the latch out of cooperation with said catch while the end of the tool applies connector-separating thrust to said abutment.

3. The combination as in claim 1, wherein the tool is a screwdriver having a wedge-like end portion and wherein said latch has a tool-engageable surface separated by a smaller space than the greatest thickness of said wedge-like portion so that progressive insertion of said wedge-like portion serves to deflect and release the tool-engageable surface of the latch.

4. Electrical apparatus including first and second electrical connectors each of which has multiple contacts insulated from each other, said connectors being adapted for plug-in assembly to each other so that the contacts of the first connector mate with respective contacts of the second connector, said first connector having an abutment against which connector-separating thrust may be applied, said connectors having only one latching device comprising a catch and a companion latch for securing said connectors releasably in their plugged-in condition, the second connector providing an insertion passage therealong adjacent to said catch along which passage an elongated tool may be thrust endwise to said abutment, said latch being positioned in relation to said insertion passage and to said abutment so that an elongated tool thrust along said passage to said abutment is operable in a single stroke for releasing said latching device and for at least partially unplugging said connectors from each other, said apparatus having means for securing said second connector against moving with said first connector while the latching device is released and connector-separating thrust is being applied to said abutment.

5. Electrical apparatus as in claim 4, wherein said latch comprise an elongated resilient extending in and along the passage of an elongated tool being thrust endwise toward said abutment.

6. Electrical apparatus including first and second plug-in electrical connectors, each of said connectors having multiple contacts that mate with respective contacts of the other of said connectors in the plugged-in condition of the connectors, said apparatus having only one latching device for securing said connectors against being unplugged from each other, said latching device having a catch and having alatch biased for maintaining said latch engaged with said catch so as to retain the connectors in their plugged-in condition, said second connector having said catch and providing a passage therealong adjacent to said catch for insertion of an elongated tool, said first connector having an abutment against which such tool, when inserted along said passage, may apply connector-separating thrust, means for mounting said second connector and for proventing said second connector from moving with said first connector when the latching device is released and when connector-separating thrust is applied to said abutment, said latching device being positioned in relation to said abutment so as to be released by a tool thrust endwise along said passage toward said abutment, whereby said latching device may be released by a tool being thrust endwise toward and against said abutment for at least partially unplugging said connectors from each other.

7. Electrical apparatus as in claim 6, wherein said latch is an elongated member having a free end carrying a latch portion engageable with said catch and having an end remote from said latch portion secured to a portion of said second connector.

8. Electrical apparatus as in claim 6, wherein said latch is an elongated member having a free end carrying a latch portion engageable with said catch and having an end remote from said latch portion secured to a portion of said second connector, said abutment being disposed adjacent to the secured end of said latch.

9. Electrical apparatus as in claim 6, wherein said latch is an elongated member extending generally along an elongated tool when endwise thrust of the tool is applied to the abutment.

10. Electrical apparatus as in claim 9, wherein said latch has fixed and deflectable ends and wherein said abutment is adjacent to the fixed end of said elongated member.

11. Electrical apparatus as in claim 6, wherein a movable portion of the latch is disposed close to another portion of the connectors in their plugged-in condition, for admitting a wedge-shaped blade portion of a screwdriver and for wedging the movable portion of the latch out of its engageable or engaged relationship to the catch.

12. In combination, first and second electrical plug-in connectors, means for securing said second connector in a fixed position, and an elongated connector-separating tool, said connectors having respective contacts, the contacts of said first connector mating with respective contacts of said second connector when the connectors are in their plugged-in condition, said connectors having only one latching device comprising a catch and a latch cooperable with the catch for blocking separation of the connectors, said first connector having an abutment against which endwise thrust of the tool may be applied for separating the connectors while the second connector is secured in said fixed position by said securing means, said second connector having said catch and providing a passage therealong adjacent to said catch for insertion of said elongated tool and thrust of said tool endwise to said abutment, said latching device being positioned in relation to said abutment so that said tool is operable in one stroke both for releasing the latch from the catch and, while the latch is released, for applying connector-separating thrust of the tool to said abutment.

13. The method of separating plug-in connectors from each other, said method being useful with apparatus having first and second plug-in connectors wherein said first connector has an abutment against which thrust may be applied in that direction which is appropriate for separating the first connector from the second connector, and wherein said connectors have a releasable latching device for retaining the connectors in plugged-in condition, said latching device including a catch on the second connector and wherein said second connector provides a passage therealong adjacent to said catch for insertion of a tool therein, the latching device being positioned in relation to said abutment so that a tool, when thrust along said passage toward said abutment in the connector-separating direction, is operable to release the latching device, said method including the steps of thrusting a tool toward said abutment in a single stroke so that the tool releases the latching device and thereafter applies connector-separating thrust against said abutment, and restraining said second connector against moving with said first connector while the tool is thrust against the abutment.

14. Electrical apparatus including first and second electrical connectors each of which has multiple contacts insulated from each other, said connectors being adapted for plug-in assembly to each other, so that the contacts of the first connector mate with respective contacts of the second connector, said first connector having an abutment against which connector-separating thrust may be applied, said connectors when in plugged-in assembly to each other providing an insertion passage along which an elongated tool may be thrust endwise to said abutment, said connectors having only one latching device comprising a catch and a companion latch for securing said connectors releasably in their plugged-in condition, said latch having a T-shaped end portion that includes mutually opposite lateral projections and said catch having catch portions engageable by said lateral projections, respectively, said latch comprising an elongated resilient element extending in and along said passage and being positioned in relation to said insertion passage and to said abutment so that an elongated tool thrust along said passage to said abutment is operable in a single stroke for releasing said latching device and for at least partially unplugging said connectors from each other, said apparatus having means for securing said second connector against moving with said first connector while the latching device is released and connector-separating thrust is being applied to said abutment.

* * * * *